US009086706B2

(12) United States Patent
Lok et al.

(10) Patent No.: US 9,086,706 B2
(45) Date of Patent: Jul. 21, 2015

(54) LOW SUPPLY VOLTAGE BANDGAP REFERENCE CIRCUIT AND METHOD

(71) Applicant: Hong Kong Applied Science and Technology Research Institute Company Limited, Hong Kong (HK)

(72) Inventors: Chi Fung Lok, Hong Kong (HK); Le Feng Shen, Shenzhen (CN)

(73) Assignee: Hong Kong Applied Science and Technology Research Institute Company Limited, Hong Kong Science Park, Shatin, New Territories, Hong Kong (CN)

( * ) Notice: Subject to any disclaimer, the term of this patent is extended or adjusted under 35 U.S.C. 154(b) by 283 days.

(21) Appl. No.: 13/783,423

(22) Filed: Mar. 4, 2013

(65) Prior Publication Data

US 2014/0247034 A1 Sep. 4, 2014

(51) Int. Cl.
*G05F 3/20* (2006.01)
*G05F 3/02* (2006.01)

(52) U.S. Cl.
CPC ..... *G05F 3/02* (2013.01)

(58) Field of Classification Search
CPC ..... G05F 3/02; G05F 3/26; G05F 3/30
USPC ..... 323/313–317; 327/538, 539, 542
See application file for complete search history.

(56) References Cited

U.S. PATENT DOCUMENTS 5,767,664 A 6/1998 Price
5,929,621 A * 7/1999 Angelici et al. ..... 323/313

(Continued)

FOREIGN PATENT DOCUMENTS

CN 1831698 A 9/2006
CN 101382812 A 3/2009
CN 202404471 U 8/2012

OTHER PUBLICATIONS

Office Action issued from the State Intellectual Property Office of the People's Republic of China on Aug. 6, 2014.

*Primary Examiner* — Matthew Nguyen
(74) *Attorney, Agent, or Firm* — Ella Cheong Hong Kong; Sam T. Yip

(57) ABSTRACT

A circuit and method for a bandgap voltage reference operating at 1 volt or below is disclosed, wherein the operational amplifier ($A_1$) drives resistors ($R_2$, $R_3$) only so that both the flicker noise contribution and the process sensitivity due to the conventional metal oxide semiconductor (MOS) devices used as a current mirror within the proportional-to-absolute-temperature (PTAT) loop are eliminated. Two symmetric resistive divider pairs formed by ($R_{1A}/R_{1B}$, $R_{2A}/R_2B$) are inserted to scale down both the base-emitter voltages ($V_{EB1}$, $V_{EB2}$) of bipolar transistors ($Q_1$, $Q_2$) and the PTAT current ($I_{PTAT}$) so that an output reference voltage ($V_{REF}$) becomes scalable. Proper bias currents through transistors ($M_3$, $M_4$), which are used to bias ($Q_1$, $Q_2$) and ($R_{1A}/R_{1B}$, $R_{2A}/R_{2B}$) respectively, are produced by an additional V-I converter (319) using $V_{REF}$ itself, resulting in a final process, voltage and temperature (PVT) insensitive output reference voltage.

9 Claims, 8 Drawing Sheets

(56) References Cited

U.S. PATENT DOCUMENTS

| | | | | |
|---|---|---|---|---|
| 6,642,778 | B2 | 11/2003 | Opris | |
| 6,885,179 | B1 | 4/2005 | Ker et al. | |
| 7,102,342 | B2 * | 9/2006 | Kim | 323/316 |
| 7,113,025 | B2 * | 9/2006 | Washburn | 327/539 |
| 7,489,184 | B2 | 2/2009 | Pan et al. | |
| 8,149,047 | B2 | 4/2012 | Tsai et al. | |
| 2008/0074172 | A1 | 3/2008 | Marinca | |
| 2012/0068685 | A1 * | 3/2012 | Chang et al. | 323/313 |

* cited by examiner

FIG.1 – PRIOR ART

FIG.2 – PRIOR ART

LOW SUPPLY VOLTAGE BANDGAP REFERENCE CIRCUIT AND METHOD

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to bandgap voltage reference circuit that provides temperature independent reference voltage, more particularly, to low supply voltage bandgap reference circuit and method.

BACKGROUND

A bandgap voltage reference circuit is used to generate a temperature independent reference voltage and is widely used in analog, digital, mixed-signal and RF circuits. Referring to the prior art in FIG. 1, it is referred to as "Voltage Mode" bandgap voltage reference because the temperature compensation is performed in voltage domain. It is well-known that the typical temperature independent bandgap voltage reference is around 1.25V at room temperature (e.g. 298K), which approximates the theoretical 1.22 eV bandgap of silicon at absolute temperature (i.e. 0K). Since the typical output voltage of such circuit is fixed around 1.25V over the temperature range of interest, the minimum supply voltage to such circuit, which is based on traditional standard CMOS technology, has to be at least 1.4V for proper function, resulting in the fundamental limitation on bandgap voltage reference operating at a low supply voltage (e.g. 1V). In order to be compatible with the state-of-the-art advanced CMOS process that the typical supply voltage is 1.2V or below (e.g. 130 nm or below), recent developments in the prior arts have proposed various low supply voltage bandgap reference solutions. Referring to the prior art shown in FIG. 2, it is referred to as "Current Mode" bandgap voltage reference because the temperature compensation is first performed in current domain and subsequently changed to voltage quantity. With this implementation, the supply voltage is no longer restricted by the theoretical silicon's bandgap voltage of 1.25V and therefore it allows the bandgap reference operating at a low supply voltage (e.g. 1V) and can be fully compatible with standard advance CMOS process. Since then, a variety of "Current Mode" bandgap voltage reference circuits are derived from this prior art. However, the implementation of "Current Mode" bandgap voltage reference must require MOS devices used as a current mirror in order to function properly. Those MOS devices contribute substantial flicker noise at the reference output due to common source configuration especially when the ground current is very small for low power consumption. Furthermore, the matching properties of active MOS devices are usually worse than those of passive resistors because MOS devices suffer from the variations of both threshold voltage and current gain whereas resistors suffer from the variation of resistance only. In other words, they enhance the process sensitivity of the reference output unfortunately. In summary, these solutions have limitations such as having high flicker noise and process sensitivity. As such, the primary objective of the present invention is to implement a low supply voltage bandgap voltage reference with lower flicker noise and less process sensitive.

SUMMARY OF THE INVENTION

It is an objective of the presently claimed invention to provide a circuit and method for generating a temperature independent bandgap voltage reference with the advantages of having both "Voltage Mode" and "Current Mode", low flicker noise, less process sensitive, and operable under low supply voltage. An embodiment of the circuit comprises a voltage-to-current converter circuit configured to generate a first reference current and a second reference current; a first differential voltage divider configured to scale down a first base-emitter voltage of a first bipolar junction transistor biased by the first reference current to generate a first scaled base-emitter voltage; a second differential voltage divider configured to scale down a second base-emitter voltage of a second bipolar junction transistor biased by the second reference current to generate a second scaled base-emitter voltage; and a bandgap voltage reference circuit configured to generate a reference voltage by using the first scaled base-emitter voltage and the second scaled base-emitter voltage. An embodiment of the method for generating a temperature independent bandgap voltage reference comprises scaling down the base-emitter voltages of bipolar junction transistors biased by reference currents; applying the scaled base-emitter voltages to a proportional-to-absolute-temperature (PTAT) loop for generating a scaled PTAT current; generating a temperature independent reference voltage from the scaled PTAT current; generating feedback reference currents until all bipolar junction transistors are properly biased over the operating temperature range, supply voltage range and process corners; and generating a process, voltage, and temperature (PVT) insensitive reference voltage from the scaled PTAT current.

BRIEF DESCRIPTION OF THE DRAWINGS

Embodiments of the invention are described in more detail hereinafter with reference to the drawings, in which.

DETAILED DESCRIPTION

In the following description, circuits for providing bandgap voltage references and associated current references and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Figure 1:
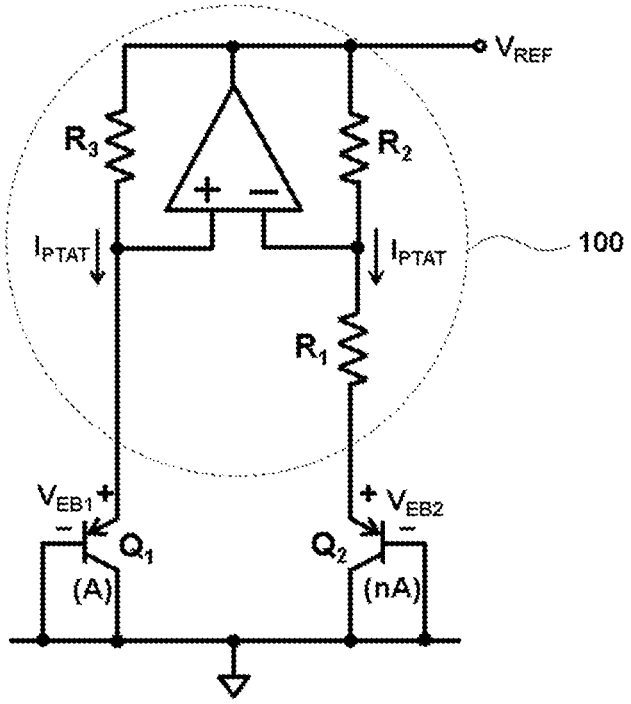
FIG. 1 is a schematic depiction of a prior art "Voltage Mode" bandgap voltage reference circuit.
Figure 3:
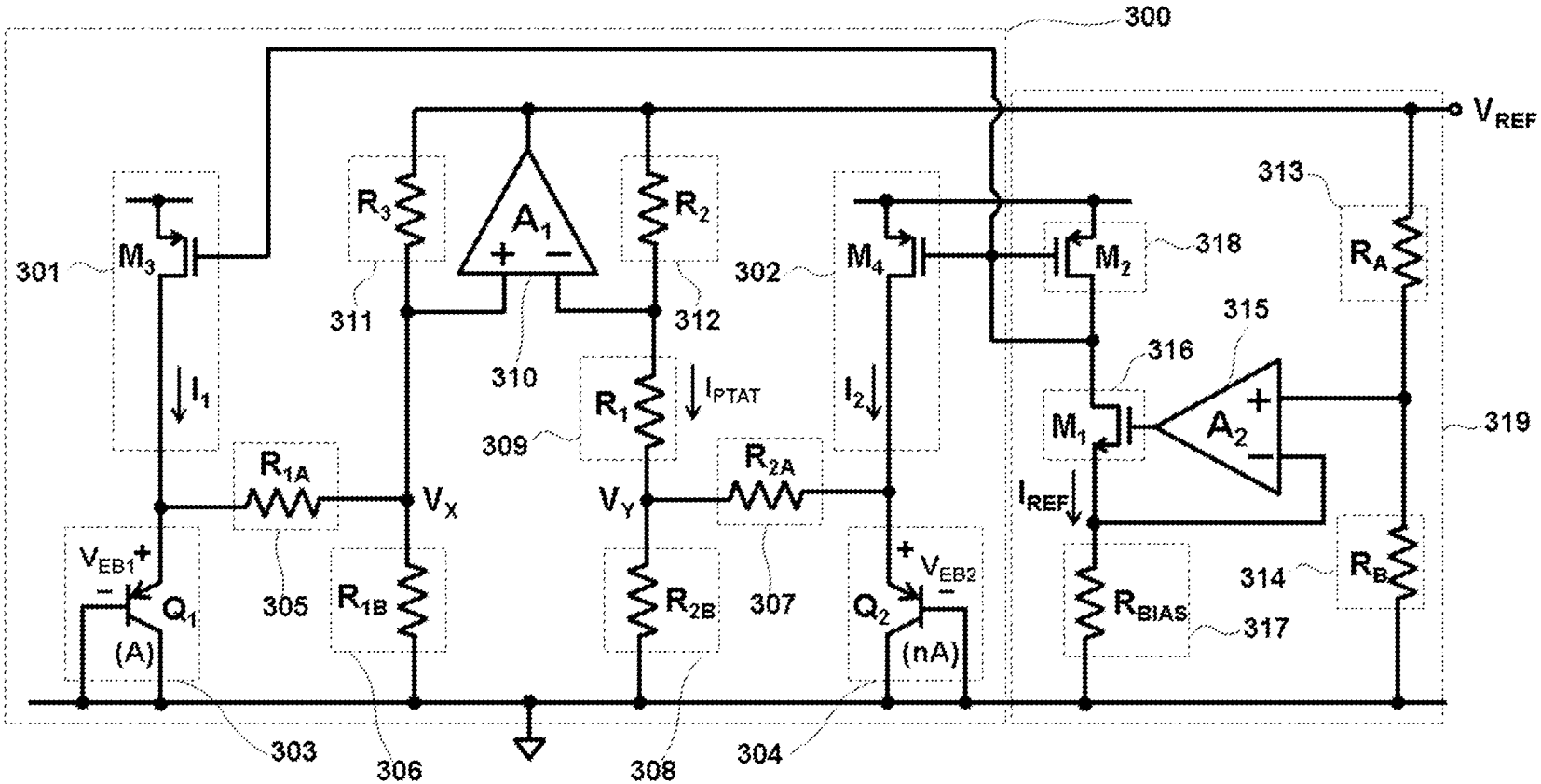
FIG. 3 is a schematic depiction of a circuit for generating a bandgap voltage reference according to an embodiment of the present invention.

FIG. 3 shows a circuit diagram of an embodiment of the circuit for generating a temperature independent reference voltage in accordance to the present invention. In this circuit, constant supply currents $I_1$ (301) and $I_2$ (302) are fed to the bipolar junction transistors $Q_1$ (303) and $Q_2$ (304) respectively to provide the corresponding base-emitter voltages $V_{EB1}$ and $V_{EB2}$. $V_{EB1}$ and $V_{EB2}$ are then scaled down by a first differential voltage divider comprising resistors $R_{1A}$ (305) and $R_{1B}$ (306), and a second differential voltage divider comprising resistors $R_{2A}$ (307) and $R_{2B}$ (308) to arrive at $V_X$ and $V_Y$ respectively, which their magnitudes are smaller than the corresponding $V_{EB1}$ and $V_{EB2}$ as can be seen in the subsequent description. In contrast to the prior art shown in FIG. 1, both $V_X$ and $V_Y$ replace $V_{EB1}$ and $V_{EB2}$, and are applied to a proportional-to-absolute-temperature (PTAT) loop for generating a scaled PTAT current $I_{PTAT}$ instead, wherein the PTAT loop comprises an operational amplifier $A_1$ (310) and three resistors $R_1$ (309), $R_2$ (312) and $R_3$ (311). This scaled PTAT current $I_{PTAT}$ flows equally across $R_2$ and $R_3$ as long as the open loop gain of the operational amplifier $A_1$ (310) is high enough (e.g. 80 dB). It is instructive to note that this core feedback loop comprises no active MOS devices in the present invention. Rather, in the present invention, the temperature independent reference voltage $V_{REF}$ is generated at the output of the operational amplifier $A_1$ (310) directly. The portion of the circuit (300) that forms the main bandgap reference: (i) enables low supply voltage operation; (ii) removes the active MOS devices for current copying in the PTAT loop that were otherwise present at "Current Mode" bandgap reference counterpart as explained; and (iii) reduces the sensitivity to fluctuation in the input common mode voltage to the operational amplifier $A_1$. Therefore, the supply voltage can be resistively scaled down to 1.2V or below according to the present invention.

The temperature independent reference voltage $V_{REF}$ is defined by:

$$V_{REF} = \frac{R_{1B}}{R_{1A} + R_{1B}}\left\{V_{EB1} + \Delta V_{EB}\left[\frac{(R_{1A} // R_{1B}) + R_2}{R_1}\right]\right\},$$

where $$\Delta V_{EB} = V_{EB1} - V_{EB2}$$

Referring to FIG. 3, the present invention does not have any active MOS device in the core feedback loop. The PTAT loop entails the advantages of having lower flicker noise performance, less strict matching requirement, and constant feedback factors. First, according to the present invention, the fundamental flicker noise performance is restricted by the operational amplifier $A_1$ only. This is in contrast to that in some of the prior arts, such as the one shown in FIG. 2, which is restricted by both the operational amplifier and the MOS current mirrors. It is important to note that the typical flicker noise is at the frequency range of 1 Hz-1 kHz where the flicker noise is not easily removed by implementing an on-chip low-pass filter due to the requirement of the very large time constant. In other words, an expensive off-chip low-pass filter is needed if one desires low flicker noise performance particularly for some applications without the appropriate clock signal available for chopper stabilization. Second, according to the present invention, the matching requirement relies on the passive components in contrast to both the active and the passive components in some of the prior arts, such as the one shown in FIG. 2. As such, the matching requirement of the present invention is much relaxed. Third, according to the present invention, both the feedback factors and noise/offset multipliers are defined by the resistive ratios, which allow a better control in mass production over process, voltage, and temperature (PVT) changes in contrast to non-ratiometric in some of the prior arts using the "Current Mode" technique. In addition, the effect of the operational amplifier $A_1$ due to offset-drift over temperature is reduced as the input common mode voltage change is reduced in contrast to the base-emitter voltage change in some of the prior arts, such as the ones shown in FIG. 1 and FIG. 2. As a result, the present invention potentially extends the operating temperature range of the bandgap voltage reference circuit to as low as −50° C. with a bipolar junction transistors' base-emitter voltage of 0.85V under a minimum $V_{DD}$ of 1.0V, and becomes favorable in view of production.

Referring to FIG. 3, FIG. 3 also shows a circuit diagram of an embodiment of a voltage-current (V-I) converter circuit (319) for providing appropriate feedback reference currents ($I_1$, $I_2$) to the circuit for generating the overall PVT independent reference voltage according to the present invention. The V-I converter circuit comprises an operational amplifier $A_2$ (315) where the temperature independent reference voltage $V_{REF}$ is supplied to its non-inverting input through a voltage divider comprising resistors $R_A$ (313) and $R_B$ (314). A biasing resistor $R_{BIAS}$ (317) is placed between the ground and the source terminal of MOS transistor $M_1$ (316). The output of the operational amplifier $A_2$ (315) drives the gate of $M_1$ (316). The drain terminal of $M_1$ (316) is connected to the diode-connected MOS transistor $M_2$ (318) serving as a current mirror circuit for generating the feedback reference current $I_{REF}$. The loop comprises the operational amplifier $A_2$ (315) and the MOS transistor $M_1$ (316) is in negative feedback. The feedback reference current $I_{REF}$ generated can eventually provide the supply currents $I_1$ (301) and $I_2$ (302) via MOS transistors $M_3$ and $M_4$ to complete an overall bandgap reference. It is important to note that both the offset voltage of the operational amplifier $A_2$ (315) and the supply current mismatches across $M_3$ and $M_4$ are suppressed by a current ratio within the natural logarithmic term. As a result, the matching requirement is still less stringent that those current mirrors used in some of the prior arts, such as the one shown in FIG. 2.

Referring to FIG. 3, if the open loop gain of operational amplifier $A_1$>>1, the feedback reference current $I_{REF}$ is defined by:

$$I_{REF} = \frac{R_B}{R_A + R_B}\frac{V_{REF}}{R_{BIAS}}$$

Still referring to FIG. 3, the definition of $V_{REF}$ can be mathematically derived by the following:

If the open loop gain of operational amplifier $A_1$>>1, then:

$$I_{PTAT} = \frac{V_X - V_Y}{R_1} \quad (1)$$

By nodal analysis at $V_X$ and $V_Y$:

$$\frac{V_{EB1}-V_X}{R_{1A}}+I_{PTAT}=\frac{V_X}{R_{1B}}\Leftrightarrow\therefore V_X=\frac{R_{1B}}{R_{1A}+R_{1B}}(V_{EB1}+I_{PTAT}R_{1A}) \quad (2)$$

$$\frac{V_{EB2}-V_Y}{R_{2A}}+I_{PTAT}=\frac{V_Y}{R_{2B}}\Leftrightarrow\therefore V_Y=\frac{R_{2B}}{R_{2A}+R_{2B}}(V_{EB2}+I_{PTAT}R_{2A}) \quad (3)$$

Substitute (2) and (3) into (1):

$$\therefore I_{PTAT}=\alpha\frac{V_{EB1}-V_{EB2}}{R_1}=\frac{\alpha\Delta V_{EB}}{R_1} \quad (4)$$

Emitter-base current of $Q_1$ is defined by:

$$I_{EB1}=I_{REF}+I_{PTAT}-\frac{V_X}{R_{2B}} \quad (5)$$

Similarly, emitter-base current of $Q_2$ is defined by:

$$I_{EB2}=I_{REF}+I_{PTAT}-\frac{V_Y}{R_{2B}} \quad (6)$$

Assume $Q_1$ and $Q_2$ have identical current gain, then:

$$\Delta V_{EB}=V_T\left[\ell n\left(\frac{I_{S2}}{I_{S1}}\right)+\ell n\left(\frac{I_{C1}}{I_{C2}}\right)\right]=V_T\left[\ell n\left(\frac{I_{S2}}{I_{S1}}\right)+\ell n\left(\frac{I_{EB1}}{I_{EB2}}\right)\right] \quad (7)$$

Consider:

$$\ell n\left(\frac{I_{EB1}}{I_{EB2}}\right)=\ell n\left(\frac{I_{REF}+\alpha I_{PTAT}-\frac{\alpha V_{EB1}}{R_{1B}}}{I_{REF}+\alpha I_{PTAT}-\frac{\alpha V_{EB2}}{R_{2B}}}\right)=\ell n\left(1-\frac{\frac{\alpha\Delta V_{EB}}{I_0R_{1B}}}{1-\frac{\alpha\Delta V_{EB2}}{I_0R_{2B}}}\right)\approx-\frac{\alpha\Delta V_{EB}}{I_0R_{1B}-\alpha V_{EB2}} \quad (8)$$

Substitute (8) into (7):

$$\Delta V_{EB}\approx V_T\left[\ell n(n)-\frac{\alpha\Delta V_{EB}}{I_0R_{1B}-\alpha V_{EB2}}\right] \quad (9)$$

Rearranging (9):

$$\Delta V_{EB}\approx\frac{V_T\ell n(n)}{1+\frac{\alpha V_T}{R_{1B}(I_{REF}+\alpha I_{PTAT})-\alpha V_{EB2}}} \quad (10)$$

Consider $I_{PTAT}$:

$$I_{PTAT}\approx\frac{\alpha V_T\ell n(n)}{R_1}\left[1+\frac{\alpha V_T}{R_{1B}(I_{REF}+\alpha I_{PTAT})-\alpha V_{EB2}}\right]^{-1} \quad (11)$$

Since (10) and (11) are recursive equations, simplification is necessary. Let:

$$I_{PTAT0}=\frac{\alpha V_T\ell n(n)}{R_1} \quad (12)$$

$$I_{REF0}=\frac{R_B}{R_A+R_B}\frac{V_{REF0}}{R_{BIAS}} \quad (13)$$

Then $I_{PTAT}$ can be estimated to be:

$$I_{PTAT}\approx I_{PTAT0}\left[1-\frac{\alpha V_T}{R_{1B}(I_{REF0}+\alpha I_{PTAT0})-\alpha V_{EB2}}\right] \quad (14)$$

(14) implies that:

$$\Delta V_{EB}\approx V_T\ell n(n)\left(1-\frac{\alpha V_T}{R_{1B}(I_{REF0}+\alpha I_{PTAT0})-\alpha V_{EB2}}\right) \quad (15)$$

Therefore, the temperature independent reference voltage $V_{REF}$ is:

$$V_{REF}=\alpha\left(V_{EB1}+\Delta V_{EB}\frac{R_{1A}\,//\,R_{1B}+R_2}{R_1}\right) \quad (16)$$

It is observed that equation (15) contains a first order temperature dependent term and a higher order temperature dependent term that is supposedly negligible to a first-order approximation. Hence, the conventional expression still holds in the present invention.

Figure 4:
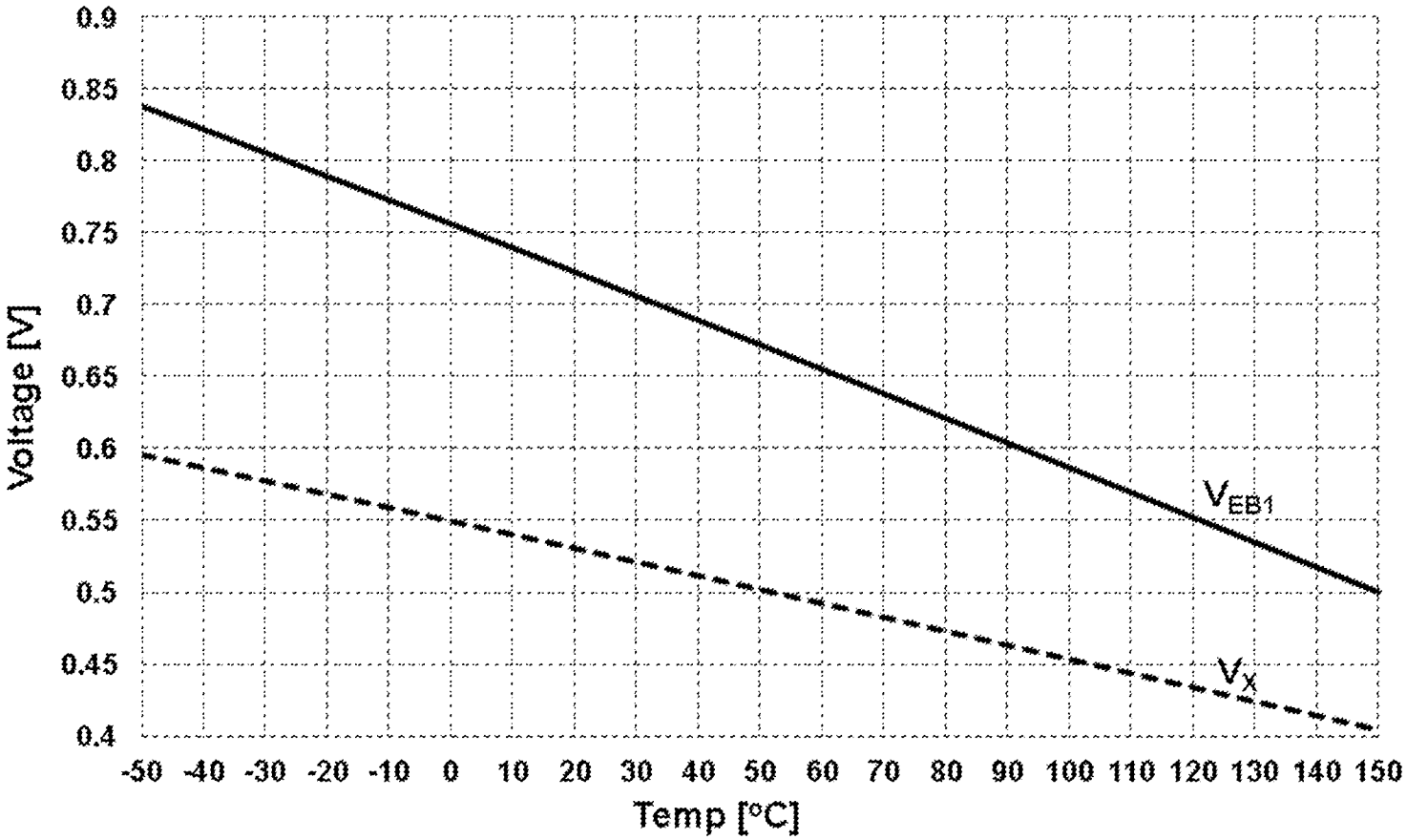
FIG. 4 illustrates the functions of base-emitter voltage and input common mode voltage of the amplifier within bandgap reference core over the temperature according to an embodiment of the present invention.

Referring to FIG. 4, the functions of $V_{EB1}$ and $V_X$ over temperature are depicted according to an illustrative embodiment of the present invention. As mentioned in an embodiment shown in FIG. 3, $V_{EB1}$ is as high as 0.85V at −50° C., $V_X$ is always smaller than $V_{EB1}$ over the entire temperature range of interest (i.e. −50° C. to 150° C.), and hence the change of $V_X$ is smaller than that of $V_{EB1}$ resulting in extending the operating temperature range and reducing the offset drift of the operational amplifier $A_1$ in the present invention.

Figure 5:
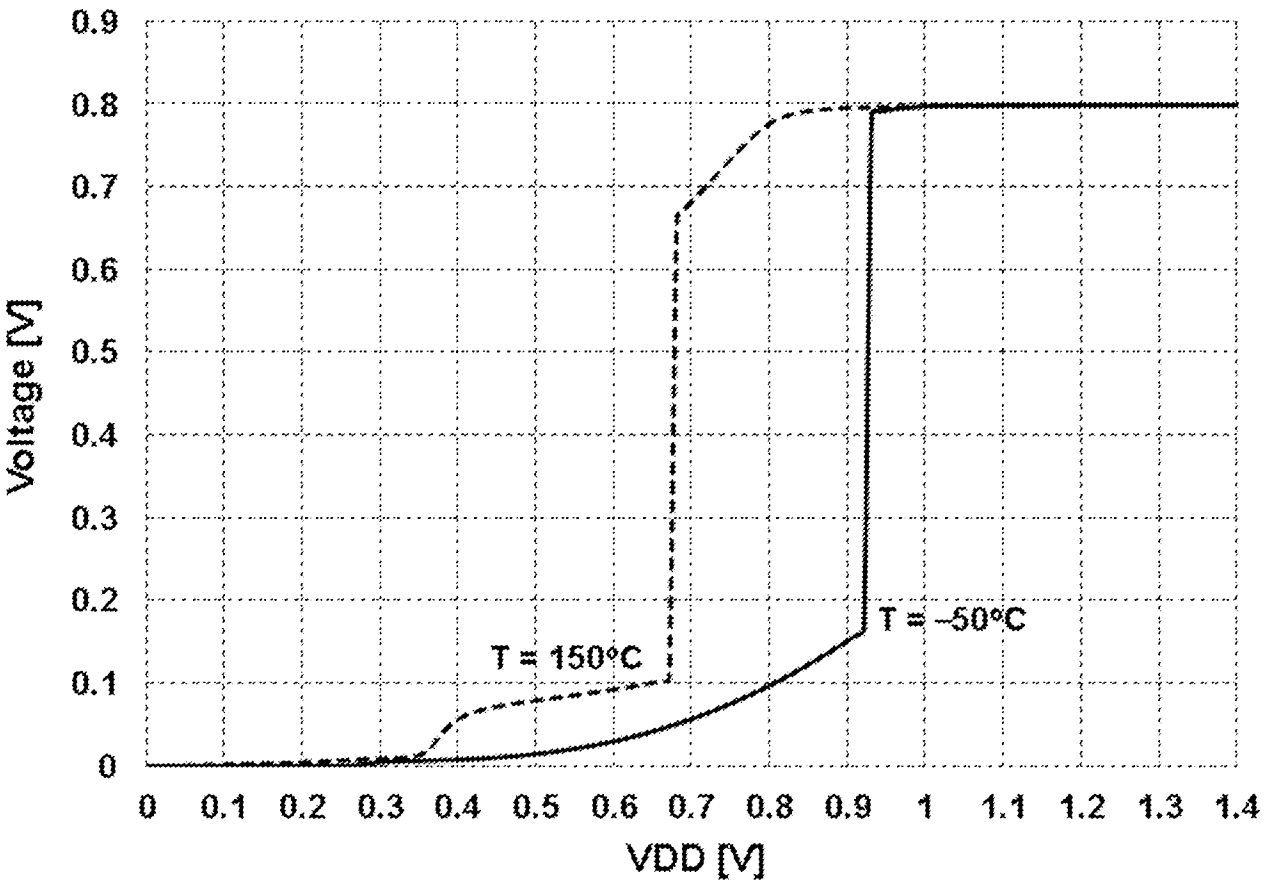
FIG. 5 illustrates the function of output reference voltage over the supply voltage at two extreme temperature conditions according to an embodiment of the present invention.

Referring to FIG. 5, the functions of $V_{REF}$ over supply voltage at −50° C. and 150° C. are depicted according to an illustrative embodiment of the present invention shown in FIG. 3. Observe that the limitation on the minimum achievable supply voltage is at −50° C. because $Q_1$ is turned on as long as supply voltage attains 0.85V or higher. The two curves of the functions of $V_{REF}$ over supply voltage at −50° C. and 150° C. converge at the supply voltage of 1V for the output reference voltage of 0.8V in an illustrative embodiment.

Figure 6:
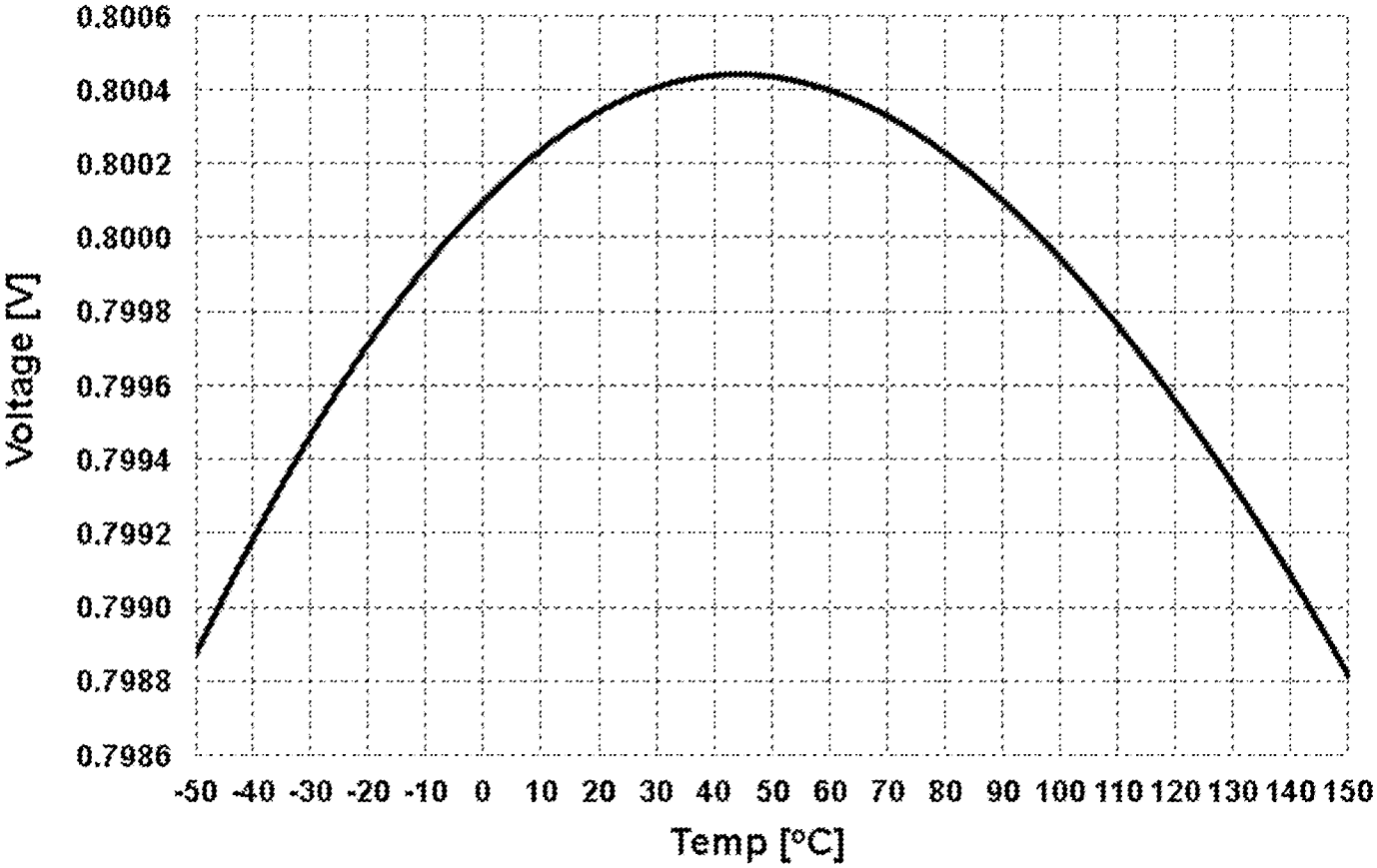
FIG. 6 illustrates the function of output reference voltage over the temperature according to an embodiment of the present invention.

Referring to FIG. 6, the function of $V_{REF}$ over temperature is depicted according to an illustrative embodiment of the present invention shown in FIG. 3. For a first-order temperature compensation, the curvature shape of the output reference remains.

Figure 2:
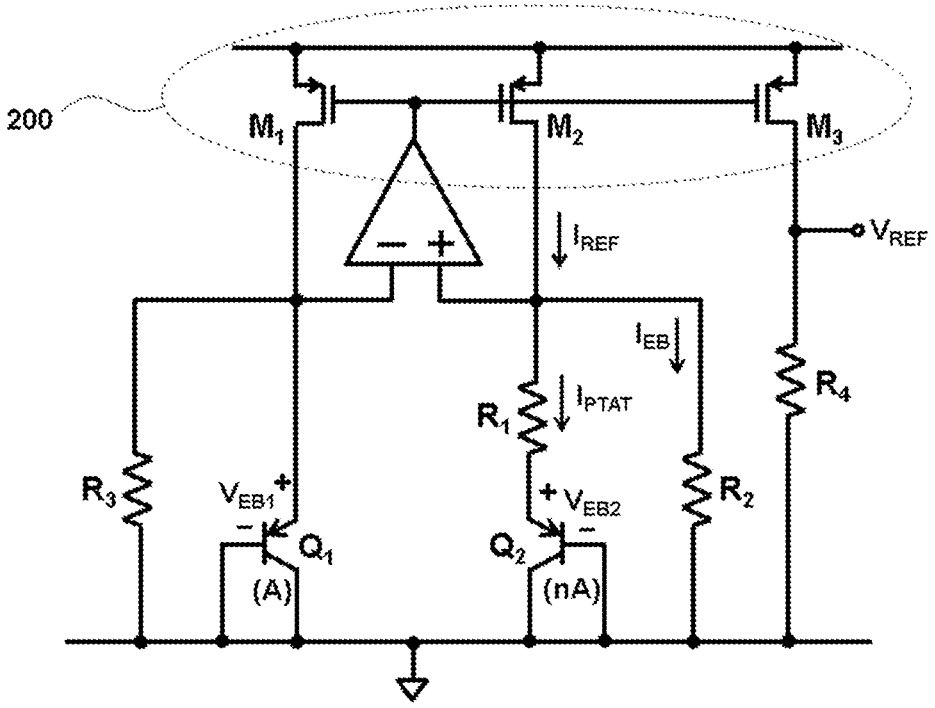
FIG. 2 is a schematic depiction of a prior art "Current Mode" bandgap voltage reference circuit.
Figure 7:
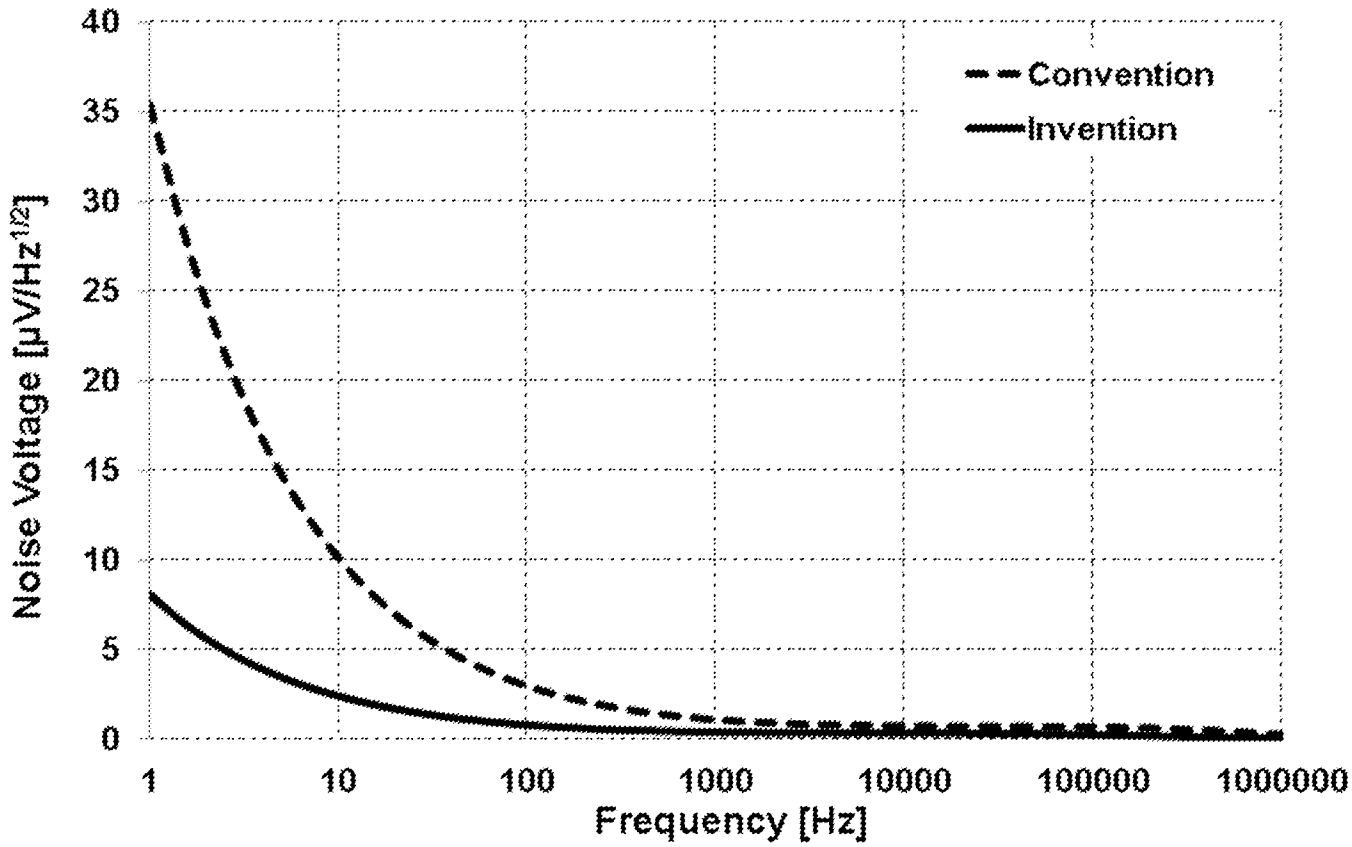
FIG. 7 illustrates the noise function of output reference voltage according to the prior art (convention) of FIG. 2 in comparison with the invention according to an embodiment of the present invention.

Referring to FIG. 7, the noise functions of $V_{REF}$ in the convention and the invention are depicted according to the prior art shown in FIG. 2 and an illustrative embodiment of the present invention shown in FIG. 3, respectively. Because of the absence of any active MOS device in the PTAT loop in an embodiment of the present invention shown in FIG. 3, the flicker noise performance is reduced significantly from 1 Hz to 1 kHz whereas their high frequency noise functions converges that can be removed by a simple on-chip low-pass filter.

Figure 8:
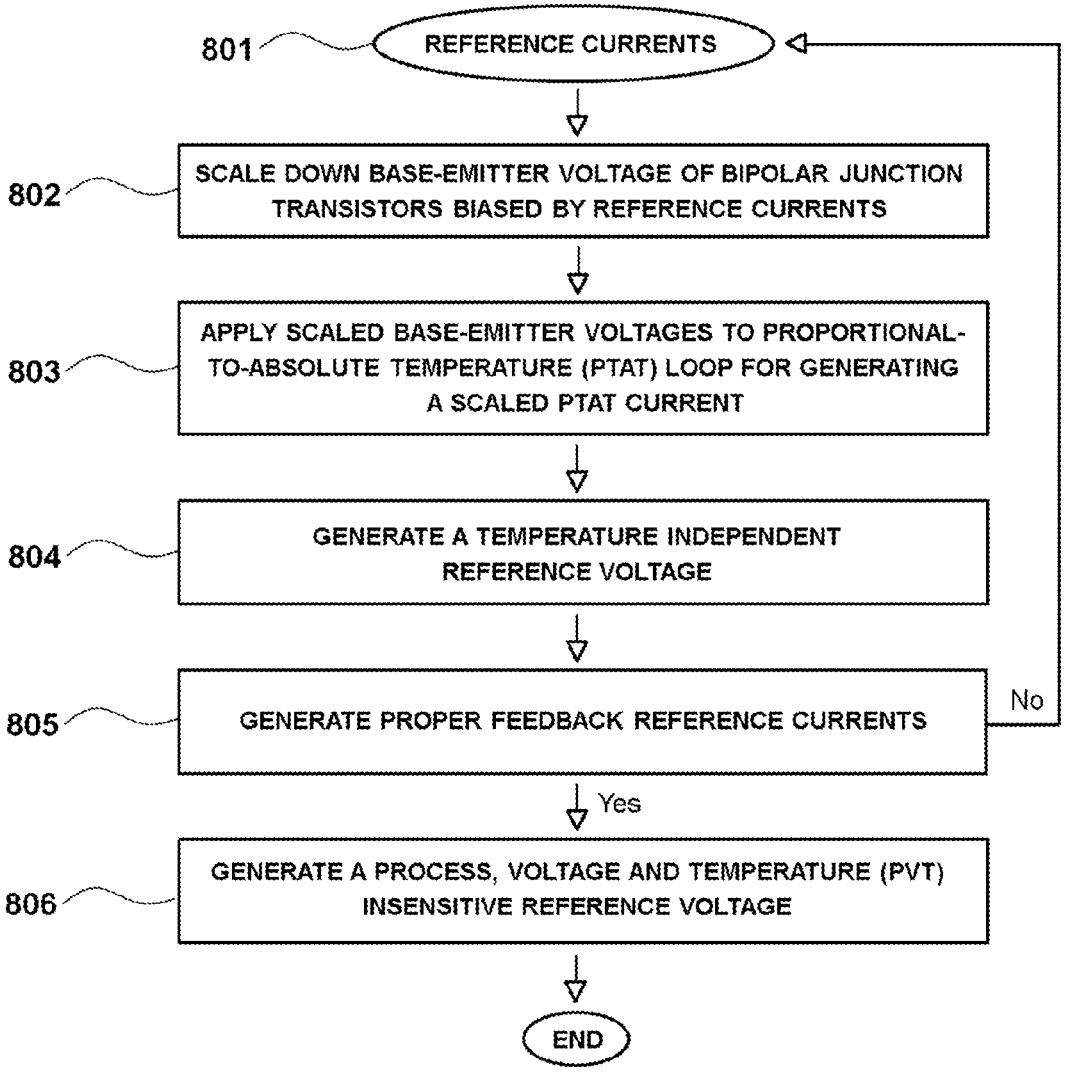
FIG. 8 is a flow chart depiction of a process of generating a bandgap voltage reference according to an embodiment of the present invention.

Referring to FIG. 8, a low supply voltage bandgap reference can be provided by a process embodiment of the present invention. The process begins with supplying reference currents (801); then scaling down of bipolar junction transistors biased by the reference currents (802); then applying the scaled base-emitter voltages to a PTAT loop for generating a scaled PTAT current (803); then generating a temperature independent reference voltage (804); then generating proper feedback reference currents (805) and feedback to the reference currents if it has not yet been done; and lastly generating a PVT insensitive reference voltage (806).

The foregoing description of the present invention has been provided for the purposes of illustration and description. It is not intended to be exhaustive or to limit the invention to the precise forms disclosed. Many modifications and variations will be apparent to the practitioner skilled in the art.

While the invention has been described with respect to various exemplary features and advantages, it will be appreciated that the present invention is not limited to such features and that numerous other variations, alternatives, and modifications can be made without departed from the scope and spirit of the appended claims.

What is claimed is:

1. A voltage reference circuit for generating a reference voltage, comprising:

a voltage-to-current converter circuit configured to generate a first reference current and a second reference current;

a first differential voltage divider configured to scale down a first base-emitter voltage of a first bipolar junction transistor biased by the first reference current to generate a first scaled base-emitter voltage;

a second differential voltage divider configured to scale down a second base-emitter voltage of a second bipolar junction transistor biased by the second reference current to generate a second scaled base-emitter voltage; and a bandgap voltage reference circuit configured to generate a reference voltage by using the first scaled base-emitter voltage and the second scaled base-emitter voltage;

wherein the bandgap voltage reference circuit comprises:

an amplifier configured as a voltage clamper to generate a scaled proportional-to-absolute-temperature (PTAT) current;

a current buffer to supply the scaled PTAT current across a first feedback resistor and a second feedback resistor; and a summing circuit to add the first scaled base-emitter voltage into the scaled PTAT current multiplied by sum of a first equivalent resistance of the first differential voltage divider and the first feedback resistor, and the second scaled base-emitter voltage into the scaled PTAT current multiplied by sum of a second equivalent resistance of the second differential voltage divider and the second feedback resistor, respectively.

2. The voltage reference circuit of claim 1, wherein the voltage-to-current converter uses the reference voltage to generate the first reference current and the second reference current.

3. The voltage reference circuit of claim 1, wherein the first reference current and the second reference current are constant and equivalent.

4. The voltage reference circuit of claim 1, wherein the first differential voltage divider and the second differential voltage divider each comprises a substantial matching resistor pair with a scalar of divider ratio.

5. The voltage reference circuit of claim 1, wherein size of the second bipolar junction transistor is of multiple of size of the first bipolar junction transistor.

6. A method for generating a reference voltage, comprising:

scaling down a first base-emitter voltage of a first bipolar junction transistor biased by a first reference current;

scaling down a second base-emitter voltage of a second bipolar junction transistor biased by a second reference current;

applying the first and second scaled base-emitter voltages to a proportional-to-absolute-temperature (PTAT) loop for generating a scaled PTAT current, wherein the PTAT loop is a part of a bandgap voltage reference circuit that comprises an amplifier configured as a voltage clamper;

generating a temperature independent reference voltage from the scaled PTAT current;

generating feedback reference currents until all bipolar junction transistors are properly biased over operating temperature range, and supply voltage range; and generating a process, voltage, and temperature (PVT) insensitive reference voltage from the scaled PTAT current using the bandgap voltage reference circuit;

wherein the bandgap voltage reference circuitbandgap voltage reference circuit comprises:

the amplifier configured as the voltage clamper to generate the scaled proportional-to-absolute-temperature (PTAT) current;

a current buffer to supply the scaled PTAT current across a first feedback resistor and a second feedback resistor; and a summing circuit to add the first scaled base-emitter voltage into the scaled PTAT current multiplied by sum of a first equivalent resistance of a first differential voltage divider and the first feedback resistor, and the second scaled base-emitter voltage into the scaled PTAT current multiplied by sum of a second equivalent resistance of a second differential voltage divider and the second feedback resistor, respectively.

7. The method according to claim 6, wherein the feedback reference currents are generated by converting the temperature independent reference voltage.

8. The method according to claim 6, wherein the scaled PTAT current is proportional to difference between the first and second scaled base-emitter voltages of the first and second bipolar junction transistors that is approximately linearly proportional to temperature.

9. The method according to claim 6, wherein non-ideal effects of the feedback reference currents are substantially suppressed by a current ratio within a natural logarithm term.

* * * * *